US010111462B2

(12) United States Patent
Doyle

(10) Patent No.: US 10,111,462 B2
(45) Date of Patent: Oct. 30, 2018

(54) VAPORIZER PROTECTIVE CASE

(71) Applicant: Joseph Miguel Doyle, Cutler Bay, FL (US)

(72) Inventor: Joseph Miguel Doyle, Cutler Bay, FL (US)

( * ) Notice: Subject to any disclaimer, the term of this patent is extended or adjusted under 35 U.S.C. 154(b) by 209 days.

(21) Appl. No.: 15/006,606

(22) Filed: Jan. 26, 2016

(65) Prior Publication Data

US 2016/0213062 A1 Jul. 28, 2016

Related U.S. Application Data

(60) Provisional application No. 62/107,942, filed on Jan. 26, 2015.

(51) Int. Cl.
*A24F 47/00* (2006.01)
*A45F 5/00* (2006.01)

(52) U.S. Cl.
CPC ..... *A24F 47/002* (2013.01); *A45F 5/00* (2013.01)

(58) Field of Classification Search
CPC .... A24F 9/14; A24F 9/16; A24F 13/22; A24F 15/12; A24F 18/20; A24F 24/002; A24F 24/008; B65D 83/20; B65D 2251/1033; B65D 47/241; B65D 51/1672; B65D 85/10
USPC ..... 131/174, 175, 176, 179, 181, 187, 329
See application file for complete search history.

(56) References Cited

U.S. PATENT DOCUMENTS 72,912 A * 12/1867 Schlichting ..... A24F 9/14 131/186
395,486 A * 1/1889 Colquitt ..... A24F 13/16 131/174
573,064 A * 12/1896 Vester ..... A24F 1/26 131/174
1,617,580 A * 2/1927 Ellis ..... A24F 9/16 131/228

(Continued)

FOREIGN PATENT DOCUMENTS

FR 3015188 A1 * 6/2015 ..... A24F 15/12
KR 2017088106 A * 1/2016 ..... A24F 15/18

OTHER PUBLICATIONS

Google Patent Translation for foreign application FR3015188A1.*

(Continued)

*Primary Examiner* — Seyed Masoud Malekzadeh
*Assistant Examiner* — Taryn Trace Willett
(74) *Attorney, Agent, or Firm* — Allen F. Bennett; Bennett Intellectual Property

(57) ABSTRACT

A protective case for housing a vaporizer or modified electronic cigarette has an elongate body with a valve at its proximal end that may be opened to provide fluid access to the mouthpiece of a vaporizer housed within it. The elongate body may include a transparent and deformable region having a valve. The actuating button on a vaporizer housed within the body may be depressed by depressing the deformable region of the housing adjacent to the actuation button. The valve in the deformable region opens when the actuating button is depressed, providing fluid access to the intake valves of the modified electronic cigarette. The interior of the case includes padding around the interior of its distal region and a piston biased by a spring to hold a housed modified electronic cigarette in a proper orientation within the case.

1 Claim, 10 Drawing Sheets

(56) References Cited

U.S. PATENT DOCUMENTS 1,934,115 A * 11/1933 Burns ..... A24F 9/16 131/176
2,028,030 A * 1/1936 Walker ..... A24F 15/12 206/269
2,079,520 A * 5/1937 Mills ..... A24F 13/14 131/175
2,267,966 A * 12/1941 Allen ..... A24F 13/14 131/175
2,346,087 A * 4/1944 Sevastopulos ..... A24F 15/12 206/236
2,870,771 A * 1/1959 Gossler ..... A24F 13/12 131/178
3,827,444 A * 8/1974 Khan ..... A24F 13/16 131/174
4,289,149 A * 9/1981 Kyriakou ..... A24F 13/14 131/175
5,590,434 A * 1/1997 Imai ..... A61C 17/3481 15/22.1
5,934,894 A * 8/1999 Cigler ..... A24F 13/20 131/249
7,929,847 B2 * 4/2011 Yim ..... G03B 17/08 206/316.2
9,609,892 B2 * 4/2017 Orvis ..... A24F 13/14
9,635,887 B2 * 5/2017 Ivey ..... A61L 9/122
2007/0000502 A1 * 1/2007 Chong ..... A24F 13/24 131/249
2007/0137658 A1 * 6/2007 Molloy ..... A24F 15/18 131/187
2007/0163608 A1 * 7/2007 Tarlow ..... A24F 15/20 131/240.1
2008/0023003 A1 * 1/2008 Rosenthal ..... A61M 11/041 128/203.26
2009/0070947 A1 * 3/2009 Baertschi ..... A45D 40/262 15/22.1
2009/0126723 A1 * 5/2009 Dhuper ..... A61M 16/06 128/200.21
2011/0061665 A1 * 3/2011 Hylton ..... A24F 9/16 131/260
2011/0315152 A1 * 12/2011 Hearn ..... A24F 47/002 131/273
2012/0138052 A1 * 6/2012 Hearn ..... A24F 47/002 128/202.21
2012/0200394 A1 * 8/2012 Morehead ..... A01M 31/002 340/8.1
2013/0167850 A1 * 7/2013 Al-Aawar ..... A24F 13/16 131/175
2013/0213418 A1 * 8/2013 Tucker ..... A24F 47/004 131/328
2013/0269717 A1 * 10/2013 Raouf ..... A24F 7/02 131/202
2014/0066144 A1 * 3/2014 Hong ..... H04B 1/3888 455/575.8
2014/0069424 A1 * 3/2014 Poston ..... A24F 47/008 128/202.21
2015/0007833 A1 * 1/2015 Orvis ..... A24F 13/14 131/328
2015/0027454 A1 * 1/2015 Li ..... A24F 47/008 131/328
2015/0027470 A1 * 1/2015 Kane ..... A24F 47/008 131/329
2015/0076014 A1 * 3/2015 Kesten ..... A24F 15/12 206/261
2015/0196061 A1 * 7/2015 Oliver ..... A24F 47/008 2/84
2015/0215439 A1 * 7/2015 Stanimirovic ..... H04M 1/215 455/572
2015/0272211 A1 * 10/2015 Chung ..... A24F 15/00 206/242
2015/0335074 A1 * 11/2015 Leung ..... A61M 15/06 131/328
2016/0015104 A1 * 1/2016 Edwards ..... A41D 1/002 2/94
2016/0022929 A1 * 1/2016 Cheng ..... A61M 11/005 128/200.16
2016/0262526 A1 * 9/2016 Gonzalez ..... A45F 5/00

OTHER PUBLICATIONS

Patent Translate for foreign application KR2017088106.*
"Sports-Haler." Auspharm SportsHaler Comments, WayBack Machine Generated NPL, Jan. 26, 2014, www.auspharm.com.au/products/asthma-relief/sports-haler/index.html.*
"Waterproof Vape." Steve Lewis, YouTube Video, Oct. 18, 2013, https://www.youtube.com/watch?v=0hvpQN_2Si8.*
"Floating Fully Waterproof Vape Mod." Steve Lewis, YouTube Video, May 25, 2016, https://www.youtube.com/watch?v=c7g_2SA8KmM.*

* cited by examiner

Prior Art
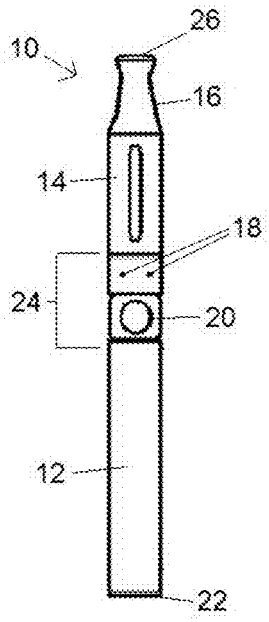
Fig. 1
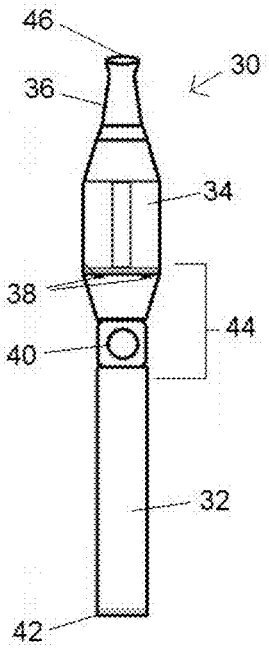
Prior Art
Fig. 2
Fig. 3
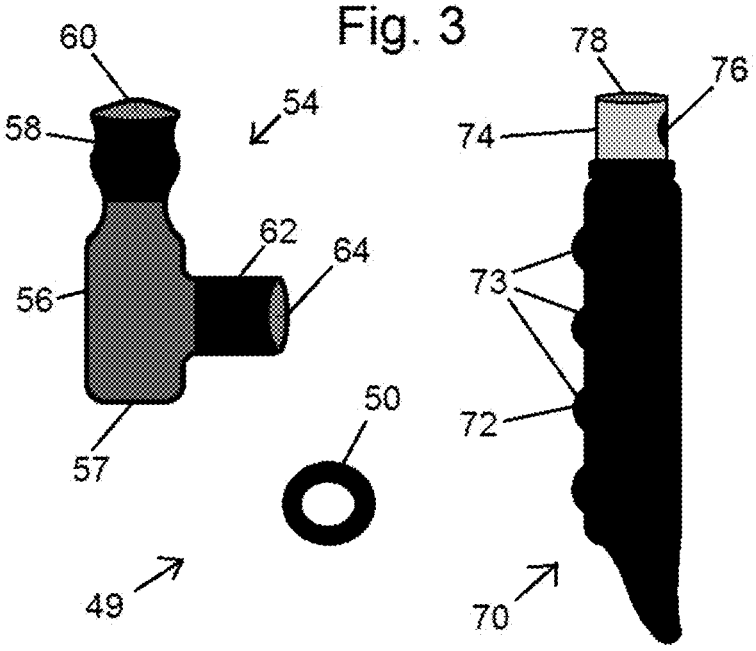

VAPORIZER PROTECTIVE CASE

CROSS-REFERENCE TO RELATED APPLICATIONS

This application claims priority to U.S. Provisional Application Ser. No. 62/107,942 filed on Jan. 26, 2015, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable.

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable.

BACKGROUND OF THE INVENTION

Field of the Invention

The present invention relates to devices, systems and methods for encasing and protecting electronic cigarettes. More particularly, the invention relates to a protective case for a modified electronic cigarette or similar device that allows the device to be operated with one hand without removing it from the protective case.

Description of the Related Art

Over the past several decades, society has become well aware of the dangers of smoking tobacco. A nimiety of techniques, products and even medications of been developed to assist in cessation of smoking tobacco. Recently, one particular device and technique, known as "vaping," has enjoyed success and popularity as a smoking cessation technique. In addition, it has gained popularity in its own right as an enjoyable activity. While many health organizations have reserved judgment, there appears to be no significant health problems associated with vaping.

Vaping devices originally were manufactured to mimic the appearance of cigarettes and cigars. These have become known as electronic cigarettes. Over time, as vaping has gained popularity in its own right, devices have been developed designed specifically for vaping itself and not as a substitute for a cigar or a cigarette. These newer devices have become known as modified electronic cigarettes, or "vaporizers."

Vaporizers a relatively lightweight and easily portable and are often carried everywhere with an owner, just like a cell phone or wallet. However, because a vaporizer includes is a mouthpiece that the user frequently inserts into his or her mouth, it is desirable to keep a vaporizer in a clean location. For more active persons, it is desirable to take a vaporizer with them even in athletic or outdoors activities. It is of course also desirable to protect a vaporizer from any damage during these activities.

In view of the foregoing, it is desirable to provide a means for protecting a vaporizer from damage caused by bumping into various objects. It is also desirable to provide a means for keeping the mouthpiece clean and free from unwanted materials.

BRIEF SUMMARY OF THE INVENTION

Accordingly, the primary object of the present invention is to provide a vaporizer case for protecting a vaporizer from contamination with air, water, sand, dust and other undesirable material.

In greater detail, the vaporizer case includes a hood that covers and seals off the mouthpiece, reservoir and atomizer portions of a vaporizer. A handle region covers the remaining portions of the vaporizer and forms an airtight seal with a washer that simultaneously seals the hood region of the case. A check valve over the mouthpiece may be actuated to open only when an operator takes a drag from the vaporizer. One or more check valves may also be provided for fluid communication with the vaporizer intakes. Similarly, only open when actuated. A flexible pad over the activation button of the vaporizer allows an operator to activate the vaporizer while it is still inside the case.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 1 is a top view of a vaporizer of the prior art;

FIG. 2 is a top view of an alternative vaporizer of the prior art;

FIG. 3 is a perspective view of a vaporizer and a washer component of a vaporizer case in accordance with the principles of the invention;

DETAILED DESCRIPTION

Figure 4:
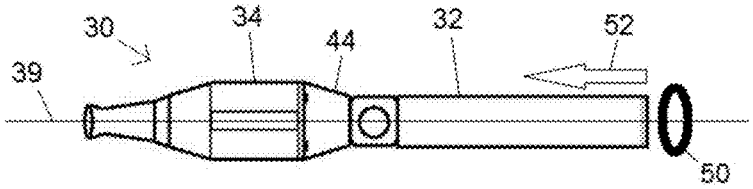
FIG. 4 is another top view of a vaporizer and a washer component of a vaporizer case in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is a vaporizer case for protecting a vaporizer from the elements, moisture, particulates and other unwanted material. The vaporizer case may include a hood and a handle. Other components, for example, a washer, may also be included. As used herein, "vaporizer" refers generally to mechanical modified electronic cigarettes, box modified electronic cigarettes, vapor pens, electronic cigarettes or other devices that provide vapor for inhalation by an operator, and these terms may be considered interchangeable with the term "vaporizer." These include vaporizers that utilize oils, concentrates, E—liquids, and solid or particulate materials.

Vaporizers of the prior art are shown in FIGS. 1 and 2. FIG. 1 shows a standard vaporizer 10 having a mouthpiece 16, a liquid reservoir 14, and a battery 12. Between the battery 12 and the reservoir 14 is the atomizer 24. The atomizer 24 may include an activation button 20 and one or more air intakes 18. The battery 12 may include a charging port 22. The mouthpiece 16 usually includes a vapor port 26. During operation, the battery 12 may be charged via charging port 22. The reservoir 14 may be filled with a liquid to be vaporized by disassembling the vaporizer 10, usually by separating the reservoir 14 from the atomizer 24 and/or the mouthpiece 16. Once the battery 12 is charged and the reservoir 14 is filled, an operator may depress the activation button 20. This causes the atomizer 24 to atomize the liquid in reservoir 14. The atomized liquid is mixed with air brought in through intakes 18. The air and atomized liquid is ejected through vapor port 26 and may be inhaled by an operator.

Similarly, an alternative vaporizer 30 shown in FIG. 2 may include a battery 32 having a charging station or charging port 42. A mouthpiece 36 having a vapor port 46 may be attached to a reservoir 34 connected to an atomizer 44. In this embodiment, reservoir 34 is larger, therefore capable of holding more liquid to be vaporized. It functions the same as the vaporizer 10 of FIG. 1. An activation button 40 may be depressed by a user, which causes liquid in reservoir 34 to be atomized and mixed with air brought in through intakes 38 and ejected out of vapor port 46.

Those skilled in the art will appreciate that the air intakes 18 and 38 perform a vital function for the device. When a user inhales through the mouthpiece, air flows into these ports and is funneled through the atomizer where it mixes with heated and atomized liquid to create the vapor. For a vaporizer to operate correctly, air must be introduced into the atomizer through these intakes. If water or another material enters the air intakes, it may block the intakes and/or damage the interior components of the atomizer. This can result an inoperable or permanently broken device. It is therefore important to prevent unwanted materials from entering the intakes. In addition, a vaporizer is not typically designed to be waterproof. As a result, the points of connection between the various components of a vaporizer may be points of entry for unwanted materials such as water or dust. It may be particularly important to protect the central region of a vaporizer, including the atomizer, from unwanted material. In addition, because the mouthpiece is placed partially within a user's mouth during operation, it is desirable to keep the mouthpiece as clean as practical.

The vaporizers shown in FIG. 1 and FIG. 2 have similar dimensions. Although there are currently no set standards adopted within the vaporizing industry, most handheld vaporizers have a shape and dimensions similar to those shown. As a result, a vaporizer case in accordance with the principles of the invention may be used with a wide variety of different vaporizers. Those skilled in the art will appreciate that the principles of the invention may be applied to most vaporizers in use today.

For clarity, throughout the specification. The end of a vaporizer where the mouthpieces are located are generally referred to as the proximal end of the vaporizer. The batteries are positioned at the distal end of the vaporizer. The longitudinal length of a vaporizer is generally defined as the distance from the proximal end to the distal end. These terms are used when referencing the vaporizers as well as the protective vaporizer cases described herein.

FIG. 3 shows the disassembled components of a modified electric cigarette case, or vaporizer case, 49 in accordance with the principles of the invention. A vaporizer case may include a washer 50, a hood 54 and a handle 70. The hood 54 may be generally designed to be placed over the top portion of a vaporizer as disclosed in more detail below. The washer 50 may be a typical washer comprised of rubber, latex or other elastomeric material. It may generally be sized and positioned to fit between the hood 52 and the handle 70.

The hood 54 may include a rigid, semi rigid or semi flexible body 56 having a vapor port valve 60 and an intake valve 64. In this embodiment, the vapor port valve 60 may be located at a distal end of a neck 58. The intake valve 64 may be located at the distal end of a sleeve 60. Valve 60 and 64 may provide a waterproof seal between the interior and exterior of the hood. Both vapor port valve 60 and intake valve 64 may be sealed when in a resting position and opened when they are squeezed from the sides. The bottom of the hood 54 includes an opening 57 through which a mouthpiece and reservoir of a typical vaporizer may be inserted.

The handle 70 may include an elongate hand grip region 72 and a collar 74 having an opening 78 and a flexible pad 76. The opening 78 allows the lower portion of a typical vaporizer to be inserted into the handle. The flexible pad 76 may align with an activation button of a vaporizer. Because pad 76 is flexible, a user may engage or impinge upon an activation button of a vaporizer while it resides within the vaporizer case. The grip region 72 may include features that facilitate firm gripping of the vaporizer case by a user. For example, handle 70. In this embodiment includes a plurality of ridges 73 in order to provide a firmer grasp. Handle 70 may be comprised of a material having relatively high static friction, such as rubber or latex and may be rigid, or semi-rigid.

Figure 5:
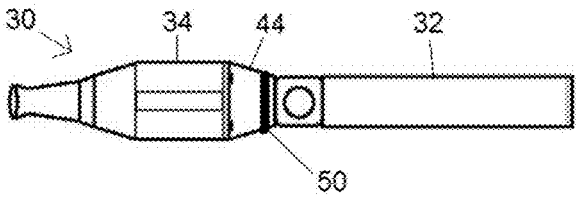
FIG. 5 is a side view of the components of a vaporizer in accordance with the principles of the invention.

The washer 50 may be positioned just "below" the air intakes of a vaporizer. FIGS. 4 and 5 show how a washer 50 of a vaporizer case may be attached to a vaporizer 30. FIG. 4 shows a washer 50 aligned longitudinally with the vaporizer 30. A washer 50 may be then moved "upward" along the longitudinal axis 39 as shown by directional arrow 52. The washer 50 may be moved upward along the longitudinal axis 39 until it engages an exterior wall of the atomizer 44, as shown in FIG. 5. The washer 50 may provide additional hermetic sealing of the vaporizer case. Washer 50 may also act as an additional barrier between the handle 70 and the hood 54 of the vaporizer case 49.

Figure 6:
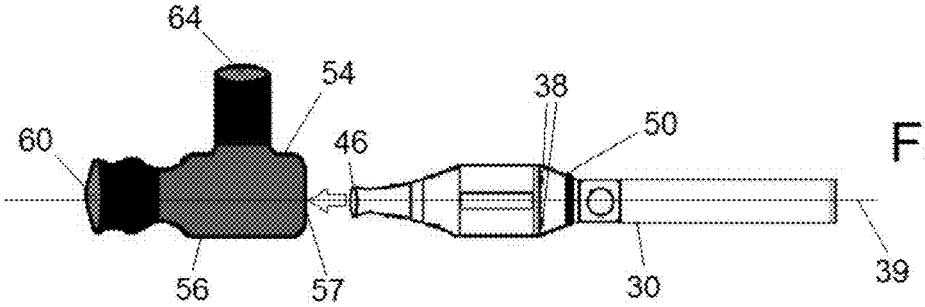
FIG. 6 is a side view of a hood component of a vaporizer case in accordance with the principles of the invention.

FIG. 6 demonstrates the insertion of the proximal region of a vaporizer 30 into the hood 54. The hood 54 may be slid over the proximal region of the vaporizer 30 by aligning it with the longitudinal axis 39 and inserting it through opening 57. The hood 54 may slide over the vaporizer 30 until it abuts washer 50. Opening 57 and washer 50 may preferably form an airtight and watertight seal. As a result, air, water or other fluids may only contact portions of the vaporizer 30 above the washer 50 by entering through valve 60 or 64.

Once the proximal region of the vaporizer 30 is fully inserted into the hood 54, the vapor port 46 may lie flush with or may abut against the valve 60. Optionally, the proximal end of the vaporizer may be positioned near but not touching the valve 60. The valve 64 may optionally align with air intakes 38. Optionally, the body 56 may be slightly larger than the exterior diameter of the reservoir 34 to allow fluid communication between the valve 64 and the vaporizer 30 above the valve 50. By providing an error space between the hood 54 and the upper region, a vaporizer 30, it may not be necessary to properly align valve 64 with air intakes 38.

In this embodiment, sleeves 58 and 62 may be rigid or flexible. Optionally, valve 64 may be located more directly on the body 56. Instead of at the end of the sleeve 62. Valves 60 and 64 may be any valve suitable for preventing air, water or other fluids from coming in the contact with the vaporizer 30. Those skilled in the art will appreciate that there are a variety of valves that may form an effective seal and may be actuated relatively easily.

Figure 7:
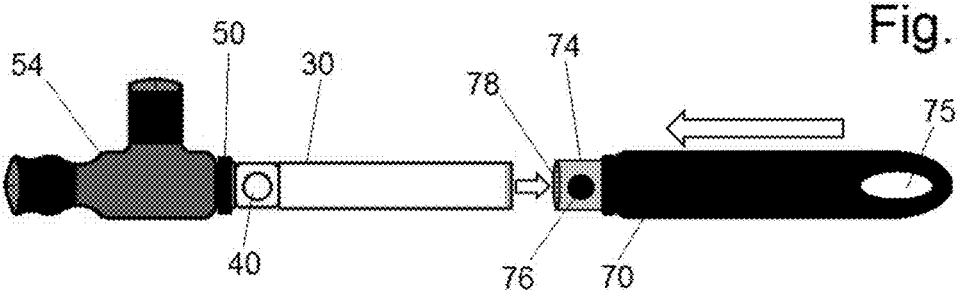
FIG. 7 is a side view of a vaporizer partially contained by a vaporizer case in accordance with the principles of the invention.
Figure 8:
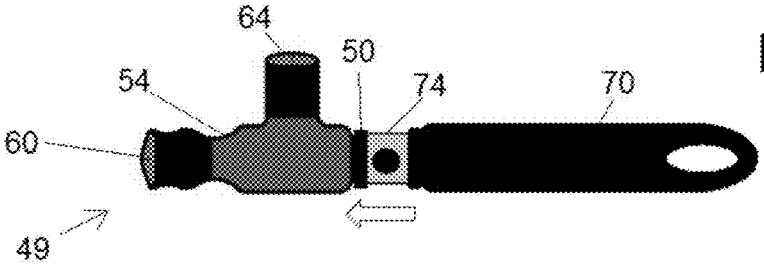
FIG. 8 is a side view of a vaporizer contained by a vaporizer case in accordance with the principles of the invention.

FIGS. 6 and 7 show the complete installation of the vaporizer case 49. Once the hood 54 has been placed over the proximal region of the vaporizer 30 and abuts against the washer 50, thereby forming a seal, the handle 70 may be slid up the distal region of the vaporizer 30. The vaporizer 30 may be inserted through opening 78 until the collar 74 abuts the washer 50 and forms a seal. The handle 70 may be positioned such that the flexible pad 76 is aligned with the activation button 40. The handle 70 may also include a loop or opening 75 so that the vaporizer case may be attached to a lanyard or hung. In use, an operator grasps the vaporizer case 49 by the handle 70 and impinges upon the activation button 40 by pressing on the pad 76. An operator may then open the valve 64 by hand or otherwise. The operator may then squeeze or bite down on the valve 60 to open it and inhale vapor from vapor port 46.

A vaporizer case in accordance with the principles of the invention may optionally include other features that may be desirable. Padding may be incorporated into the vaporizer case to protect the vaporizer from drops or other shocks. The vaporizer case may optionally include various handles, for example, a clip similar to those commonly found on writing utensils, a clamp, a device designed to engage a specific mount as has been used with cell phones, or the like.

Figure 9:
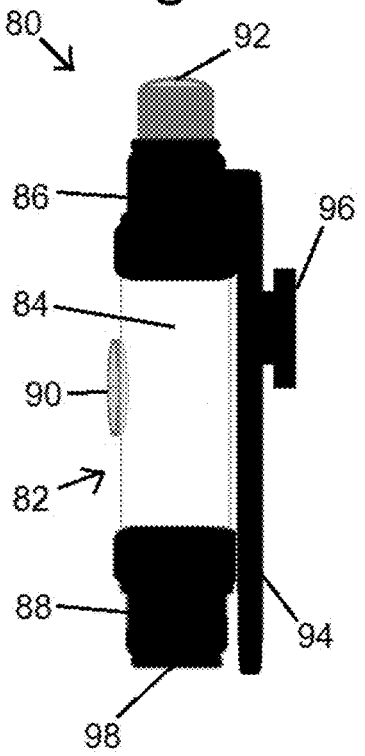
FIG. 9 is a side view of an alternative embodiment of a hood in accordance with the principles of the invention.

FIGS. 9-13 show an alternative embodiment of a vaporizer protective case in accordance with the principles of the invention. FIG. 9 shows a hood 80 having an elongate body 82. The body 82 may include a cylindrical flexible tube 84 extending between an upper cap 86 and a lower cuff 88. All or some of the components of the hood 80 may be impact resistant. The flexible tube 84 may include one or more air intake valves 90. When the flexible tube 84 is squeezed by an operator, this may open the intake valve 90. When no pressure is applied to the tube 84, it may return to a closed position.

The upper cap 86 may be rigid, semi-rigid or flexible and may include a vapor valve 92, at its upper end. The upper valve 92 may be opened by an operator squeezing or biting down it. The cap 86 may optionally include a pocket clip 94 and/or a mounting device 96. The pocket clip 94 may allow the upper cap 86 to be affixed to a pocket in a shirts or pants.

The mounting device 96 may be designed to attach to a mounting anchor that may be placed on an operator's belts, garment or other object.

The cuff 88 may be rigid, semi-rigid or flexible. It may generally be preferable for the cuff 88 to be semi-rigid or rigid at least around the opening 98 in order to facilitate connection with a complementary handle provided in accordance with the principles of the invention.

Figure 10:
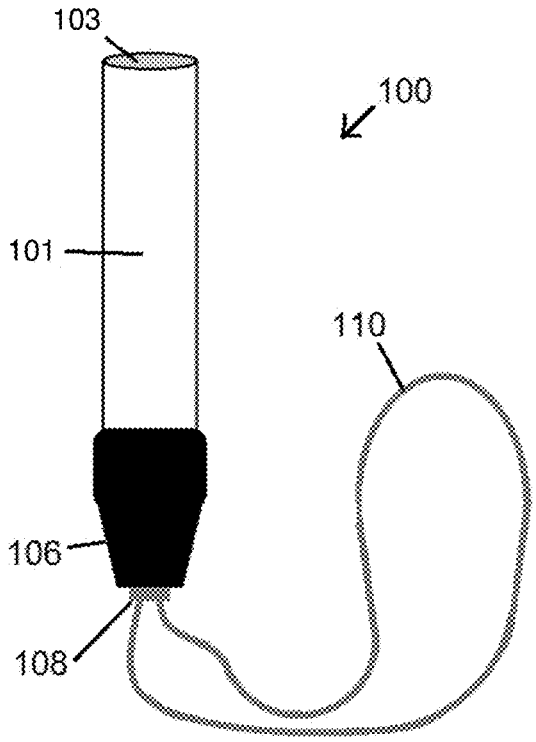
FIG. 10 is a side view of an alternative embodiment of a handle in accordance with the principles of the invention.

FIG. 10 shows a handle 100 complementary to the hood 80 shown in FIG. 9. The handle may be comprised of an elongate sleeve 101 having an opening 103 at its upper end. The handle 100 may also include a base 106. In this embodiment, the base 106 may include a plug 108 having a lanyard 110. Optionally, the plug 108 may be detachable, and may allow access to a recharging port on a vaporizer held inside it.

Figure 11:
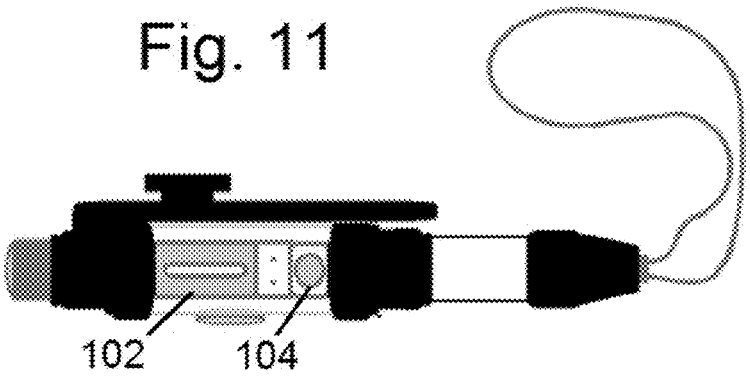
FIG. 11 is a side view of an alternative embodiment of a protective case housing a vaporizer in accordance with the principles of the invention.

FIG. 11 shows the hood 80 and handle 100 connected to form the vaporizer case 100 placed over a vaporizer 112. The cuff 88 may fit over the sleeve 101, and provide an airtight and watertight seal. In use, an operator may actuate the power button 104 depress or squeeze the flexible tube 84, thereby simultaneously turning on the vaporizer 102 and opening the air intake valve 90. In this manner, a vaporizer may be activated and used with only one hand. The tubing 84 provides at least some clearance between it and the vaporizer 104. As a result, it may not be necessary to accurately align the air intake valve 90 and the air intakes on the vaporizer itself.

Figure 12:
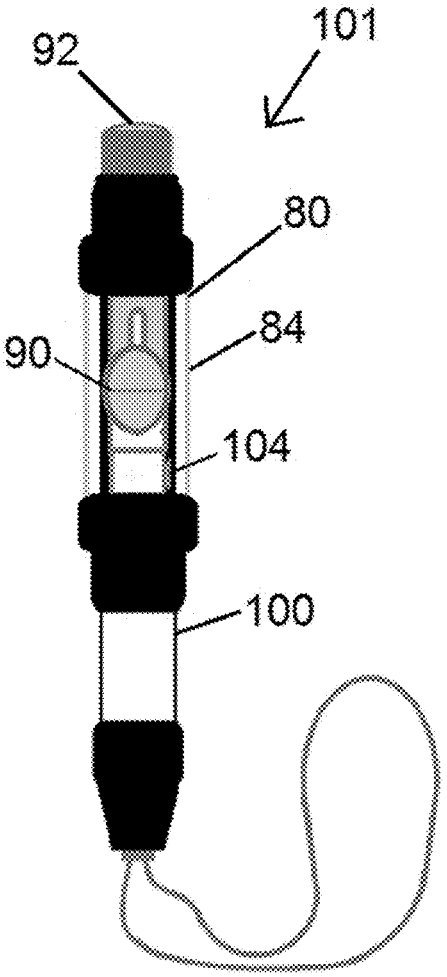
FIG. 12 is a front view of a vaporizer case in an airtight and watertight configuration in accordance with the principles of the invention.
Figure 13:
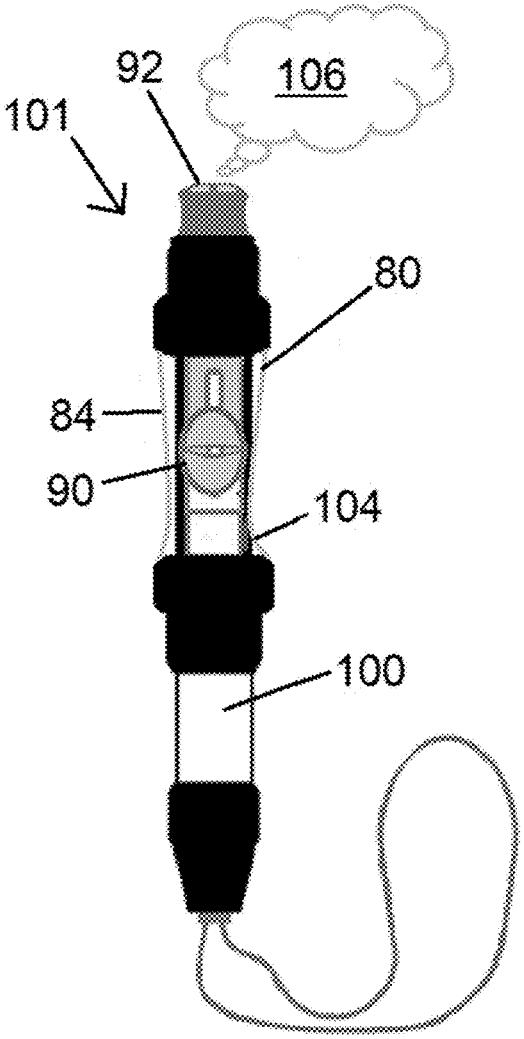
FIG. 13 is a front view of a vaporizer case in an activated, open position in accordance with the principles of the invention.

FIGS. 12 and 13 show the vaporizer case 101. In the closed and opened positions, respectively. When in the closed position shown in FIG. 12, the valves 90 and 92 are both closed. To use the vaporizer, an operator may squeeze the tube 84 over the power button 104 to sufficiently depress the power button 104. This may cause the valve 90 to open. At the same time, an operator may squeeze the valve 92 by biting with his teeth or otherwise, thereby opening it, such that it expels vapor 106.

FIGS. 14-17 show an alternative embodiment of a protective modified electronic cigarette case 120 in accordance with the principles of the invention. The vaporizer case 120 includes an elongate body 122 having a length 123 defined by a proximal end 124 and a distal end 126. In this embodiment, the proximal region 130 includes a removable top 127 having a mouthpiece 128 at its proximal ends and is removably attachable to the rest of the body 120. The removable top 127 may be removably affixed to an opening 132 at the proximal end of a collar 146 by any suitable mechanism such as a friction fit, interference fit, screwing of complementary threading or other mechanisms capable of holding the mouthpiece affixed to the body.

Figure 14:
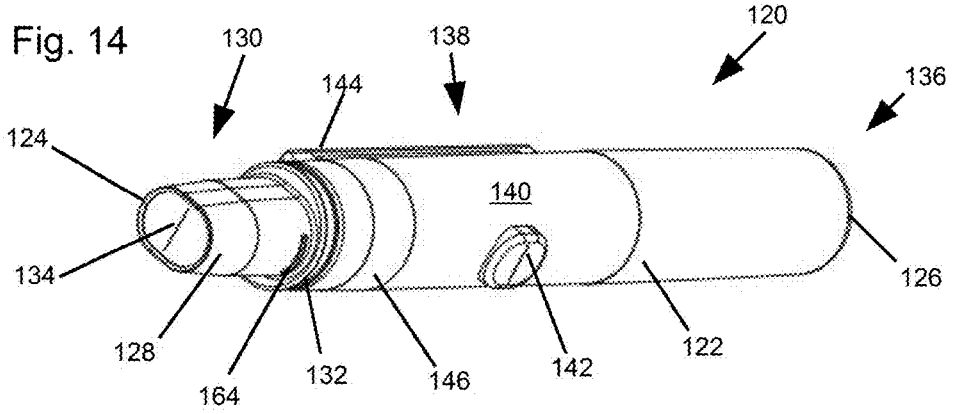
FIG. 14 is a perspective view of an alternative embodiment of a vaporizer case in accordance with the principles of the invention.
Figure 15:
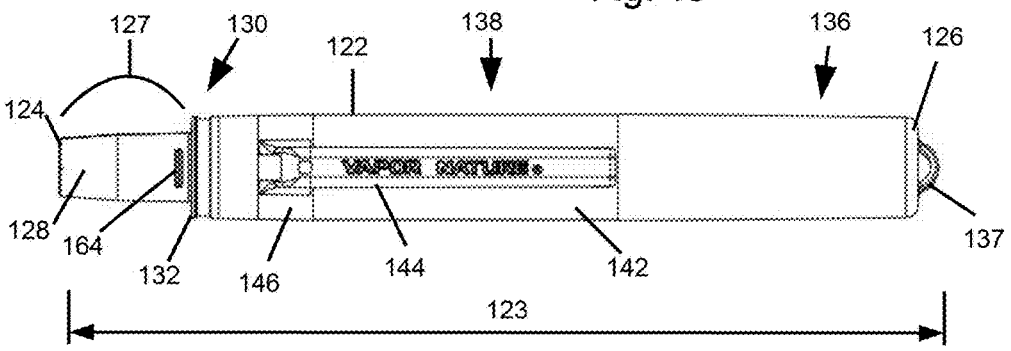
FIG. 15 is a side view of an alternative embodiment of a vaporizer case in accordance with the principles of the invention.
Figure 16:
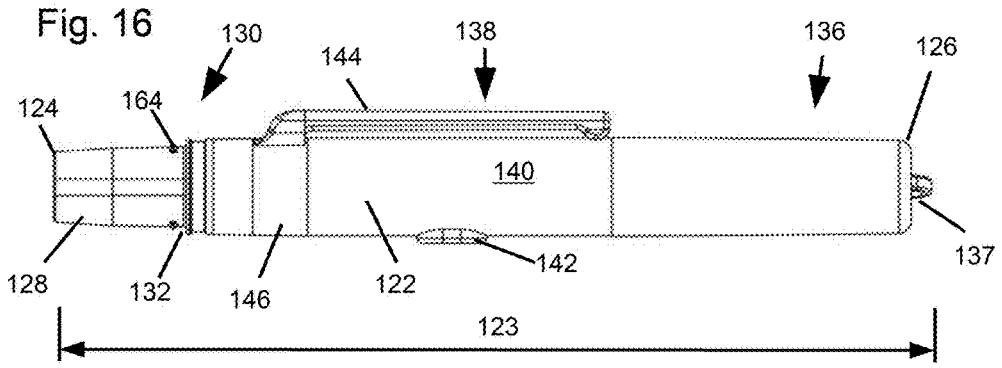
FIG. 16 is another side view of an alternative embodiment of a vaporizer case in accordance with the principles of the invention.

FIG. 14 shows the mouthpiece 128 includes a valve 134 and is configured and sized to comfortably fit within a person's mouth. In this embodiment, the valve 134 is a bite valve and that is opened by biting down on it but otherwise remains closed. Optionally, the valve may be a check valve, a duckbill valve, an umbrella valve or other type of valve that can be opened and closed using either of the operator's mouth or the operator's hand that is holding the case 120. The distal end 136 includes a through hole 137 that allows attachment of the device to a lanyard, tether or other device for securing the case 120 to a person or object. The distal region 136 of this embodiment houses internal components described in more detail below. The portion of the body 122 within the distal region 136 is cylindrical and composed of a rigid or semi rigid material that may include padding on the exterior or interior. Optionally, the body 122 can be parallelepiped or angular in shape being prismatic having a polygonal cross-section or formed from different sections having different cross-sectional shapes so long as it is suitable for housing a modified electronic cigarette.

The medial region 138 includes at least partially with in it a deformable region 140 that is comprised of a transparent, deformable elastomeric material. This deformable region also includes an intake valve 142. Because vaporizers come in a variety of different shapes and sizes, their actuating button's and intake valves are found in a wide variety of different positions or locations on the body of the vaporizer. Manufacturing several different configurations of a vaporizer case to conform to each individual type of vaporizer, the vaporizer case 120 of the present invention includes this transparent region that allows an operator to identify the location of the actuation button for his or her particular vaporizer design. The operator depresses the deformable rubber at the correct location in order to depress the actuation button of the vaporizer housed within the case 120. The action of squeezing the deformable region 140 in order to actuate a vaporizer housed within also simultaneously deforms the intake valve 142, thereby opening the valve 142 to provide air to intake to the valves of the vaporizer. Because the valve 134 of the mouthpiece 128 may be actuated by an operator's mouth while the actuation button of the vaporizer and the intake valve 142 may be actuated by the operator's hand that is holding the case 120, an operator may use the vaporizer housed within the vaporizer case 120 with only one hand, leaving his or her secondhand free for other activities.

An attachment clip 144 may be similar to clips commonly found on a writing utensil may also be incorporated into the design of the vaporizer case 120. The attachment clip 144 may optionally include a through hole for attachment to a lanyard, leash, tether or the like. The incorporation of the attachment clip or similar device may assist in efficient and convenient storage and retrieval of the vaporizer case 120. The clip 142 is attached to the body 120 at the rigid collar 146.

Figure 17:
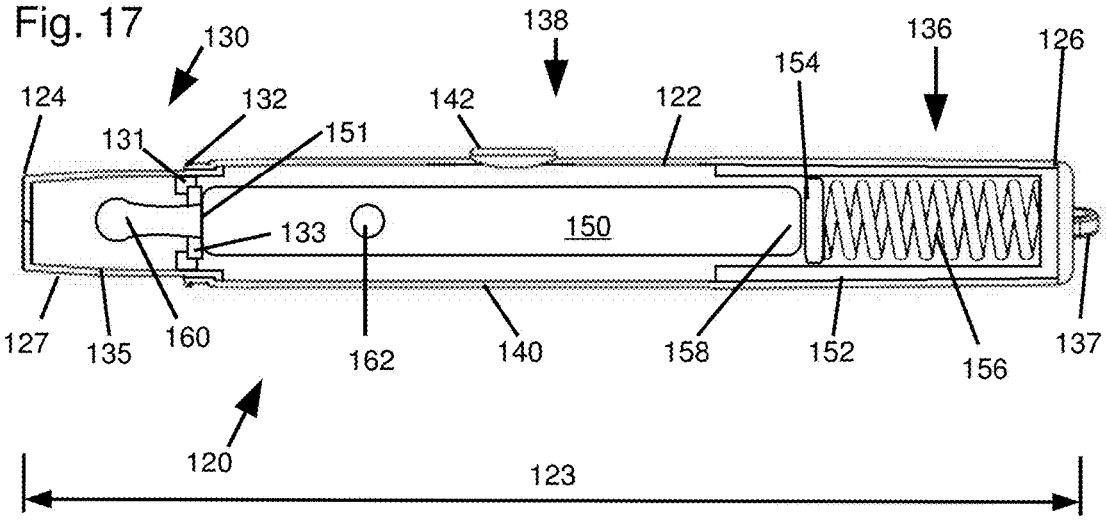
FIG. 17 is a cross-sectional view of an alternative embodiment of a vaporizer case housing a vaporizer in accordance with principles of the invention.

FIG. 17 shows a cross-section of a vaporizer case 120 having a vaporizer 150 housed within it. The distal region 136 includes a cylindrical interior padding 152 that cushions and limits transverse movement of the vaporizer 150 within the case 120. A piston 154 is positioned at the proximal end of a spring 156 that provides bias in a proximal direction. The piston 154 abuts the distal end 158 of the vaporizer 150, thereby limiting longitudinal movement of the vaporizer 150 within the case 120. The bias of piston 154 and spring 156 also pushes the mouthpiece 160 of the vaporizer 150 against an annular shoulder 131 extending around the inside wall 135 of the top 127. The annular shoulder 131 includes an elastomeric O-ring 133. The proximal bias created by spring 156 pushes the body 151 of the vaporizer 150 against the O-ring 133. Because the top 151 of the vaporizer 150 abuts the O-ring 133, a substantially airtight seal is formed between the top 127 and the rest of the body 122. When an operator bites down on the mouthpiece 128, the valve 134 is opened, providing fluid communication between the mouthpiece 160 of the vaporizer 150 and an operator's mouth but does not provide fluid communication with other interior regions of the case 120. The actuating button 162 of the vaporizer 150 is positioned within the deformable region 140 of the body 122 such that it may be visually located by an operator.

By including the piston 154 and by a spring 156, the vaporizer case 120 may house vaporizers having different lengths. The piston 154 and spring 156 also allow the case 122 position a vaporizer housed within it such that the mouthpiece of the vaporizer is positioned within the top 127 and positions the actuating button within the deformable region 140 so that their location may be visually determined by an operator. By including padding lining the interior wall of the distal region, the case 120 prevents or limits transverse or side to side movement of the vaporizer within the case 120. The padding 152 may optionally include one or more flutes and order to have physical contact with a variety of vaporizers of different diameters and more securely hold them in place with in the case 120. The vaporizer case 120 may thus be used to house a wide variety of vaporizers having different lengths, diameters and configurations.

Figure 18:
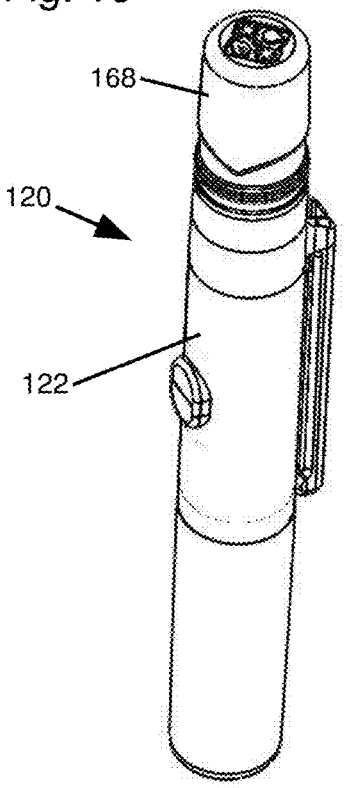
FIG. 18 is a perspective view of an alternative embodiment of a vaporizer case having a cap covering the mouthpiece in accordance with the principles of the invention.
Figure 19:
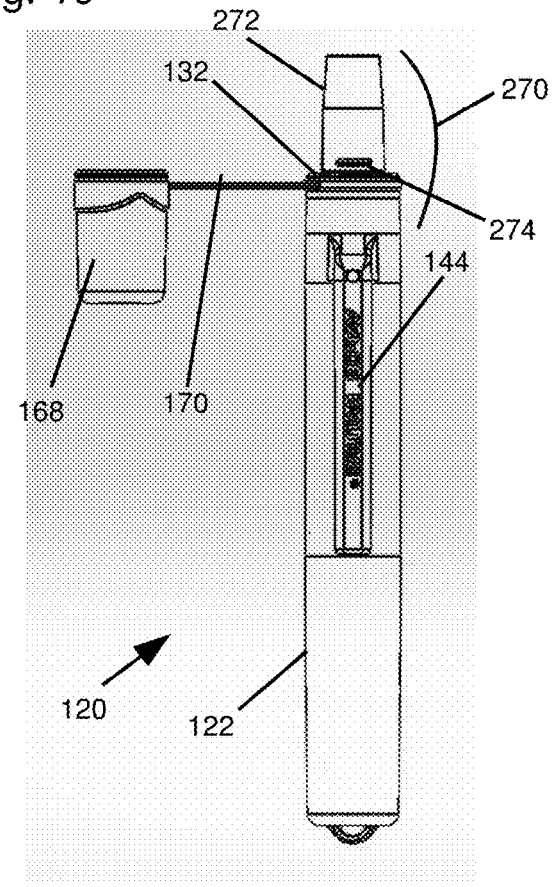
FIG. 19 is a perspective view of alternative embodiment of a vaporizer case having a cap connected to the vaporizer case by a leash in accordance with the principles of the invention.

FIGS. 18 and 19 show the vaporizer case 120 with a cap 168 tethered to the body 122 of the case 120 by a leash 170. A detent 274 positioned near the distal end of the top 270 allows the cap 168 to snap onto and over the mouthpiece 128. The cap 168 protects the mouthpiece 128 which is often made of softer, more pliable material and also prevents unwanted contact between the mouthpiece 128 and other items. This keeps the mouthpiece 128 reasonably clean and also prevent accidental opening and closing of the valve at the proximal end. Incorporating the cap 168 into the design of the case 120 may create a more streamlined and as that a clean pleasing profile. The top 270 shown in FIG. 19 embodies an alternative design for a top component. As described in more detail below, 272 has interior threading in its distal region to provide removable attachment to the rest of the body 122 by using a threaded screwing mechanism.

Figure 20:
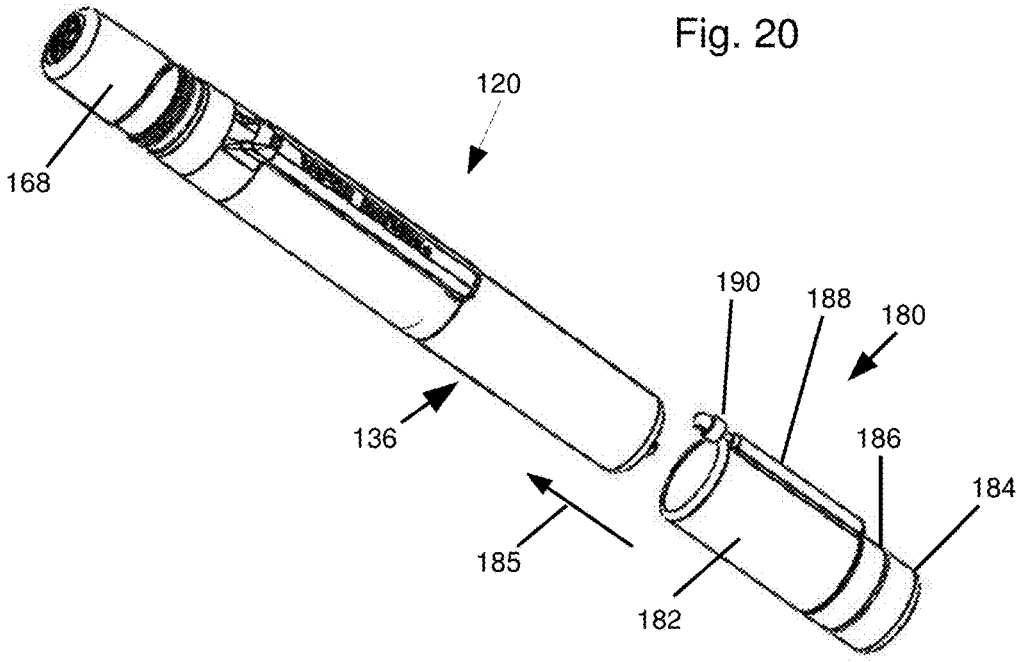
FIG. 20 is a perspective view of an alternative embodiment of a vaporizer case including a storage attachment in accordance with the principles of the invention.
Figure 21:
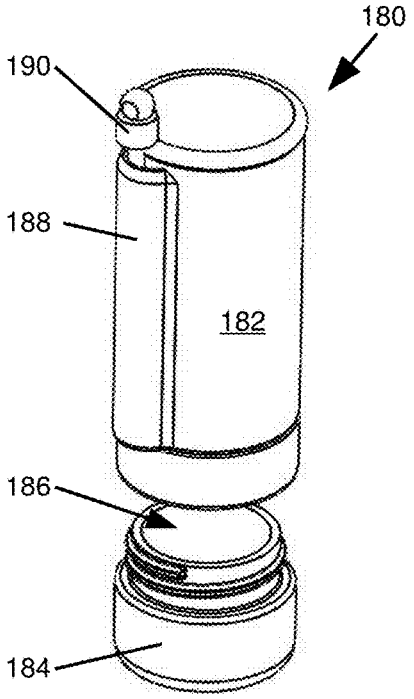
FIG. 21 is a perspective view of a storage attachment for a vaporizer case in accordance with the principles of the invention.
Figure 22:
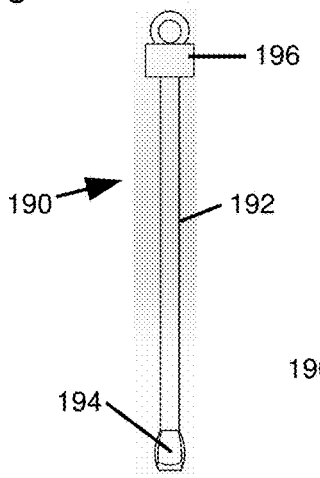
FIG. 22 is a front view of a dabber in accordance with principles of the invention.
Figure 23:
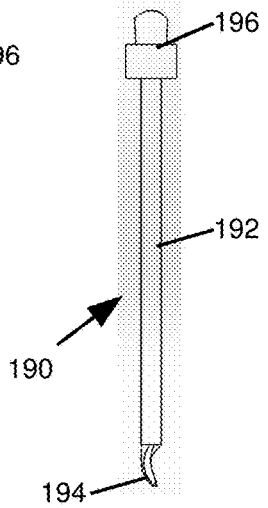
FIG. 23 is a side view of a dabber in accordance with the principles of the invention.

FIGS. 20-23 show accessories that may be incorporated into a vaporizer case 120. FIG. 20 shows a vaporizer case 120 having a cap 168 affixed over the mouthpiece and longitudinally aligned with an additional storage attachment 180. The storage attachment includes an elastomeric sleeve 182 configured to be placed over the distal end 136 of the case 120 by sliding it in the direction of arrow 185. The elastomeric sleeve 182 may be comprised of rubber or other material and fits snugly over the distal end 136 of the case 120 to form a secure interference fit. The storage attachment 180 includes a storage compartment 186 covered by a screwcap 184. An interior chamber of the storage compartment 186 may be substantially waterproof and may be accessible via the removably attachable screwcap 184.

The storage attachment 180 may also include an elongate pocket 188 also comprised of an elastomeric material to form an interference fit with a dabber 192 hold it within the pocket 188 when not in use. The dabber 190 is a tool or instrument for use in manipulating oils or other materials being placed within or taken out of the reservoir of a vaporizer. It may also be used to manipulate material stored within the compartment 186. The compartment 186 is accessible by unscrewing the screwcap 184 from the bottom of the attachment 180. A dabber 190 is formed from a relatively rigid and starting material and includes an elongate stem connecting the handle 196 to the scoop 194. In this embodiment, the scoop 194 is in the form of a curved spade but may also take the form of a spoon, a pointed tip or other configuration. Optionally, the storage attachment 180 may be configured to be removably attached to a vaporizer case by a mechanism other than an interference fit sleeve. For example, it may use threaded screws, a snap fit or other design. Optionally, the distal ends of a vaporizer case may have a storage compartment integrally formed in it, making a storage attachment unnecessary. Similarly, an elongate pocket configured to retain a dabber or similar tool may optionally be incorporated into the body of a vaporizer case.

Figure 24:
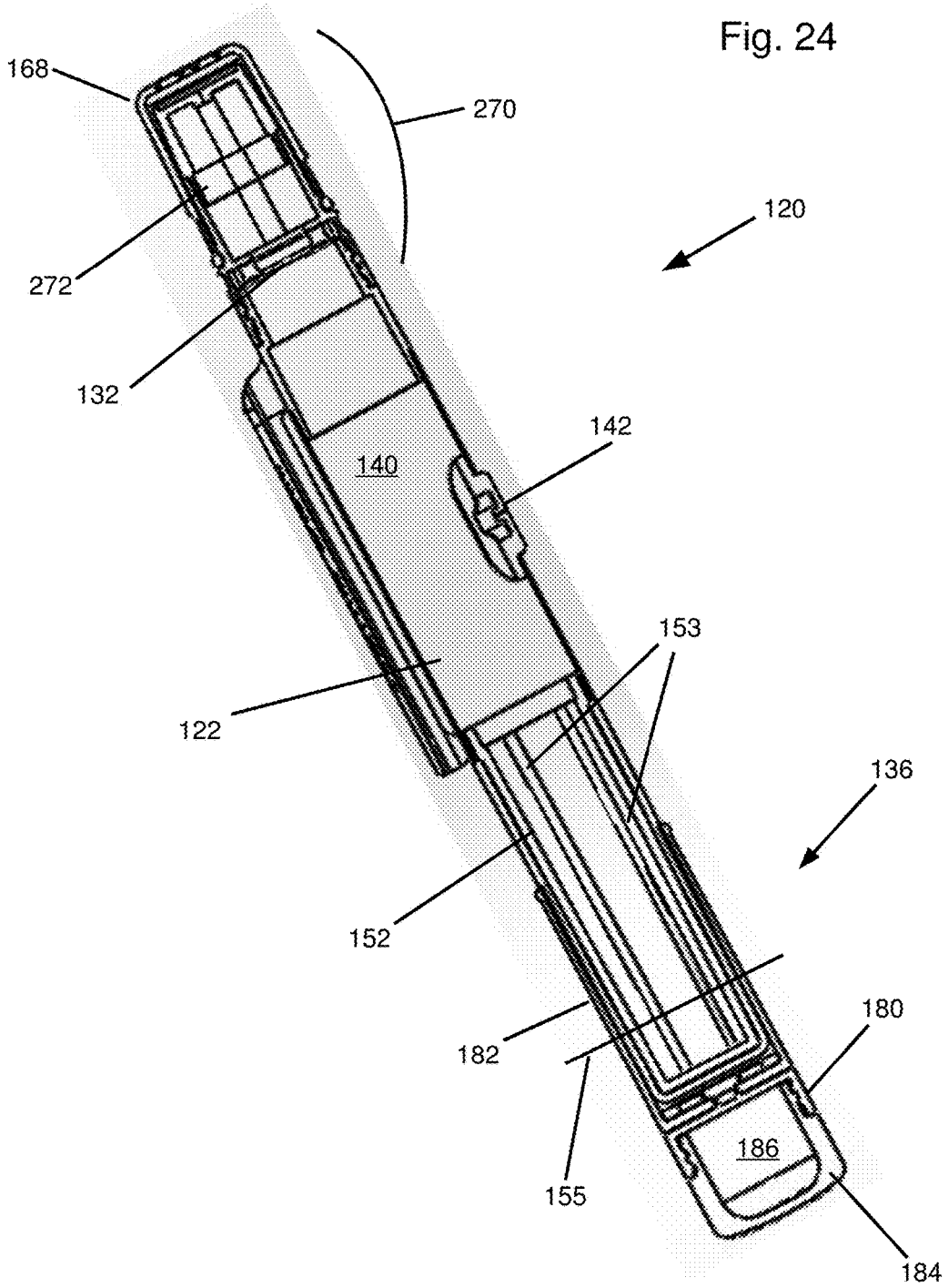
FIG. 24 is a cross-sectional view of an alternative embodiment of a vaporizer case having a cap and a storage attachment in accordance with principles of the invention.
Figure 25:
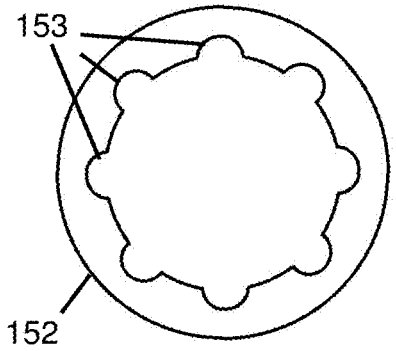
FIG. 25 is a cross-sectional view of the padding within the distal region of the alternative embodiment of a vaporizer case in accordance with principles of the invention.
Figure 26:
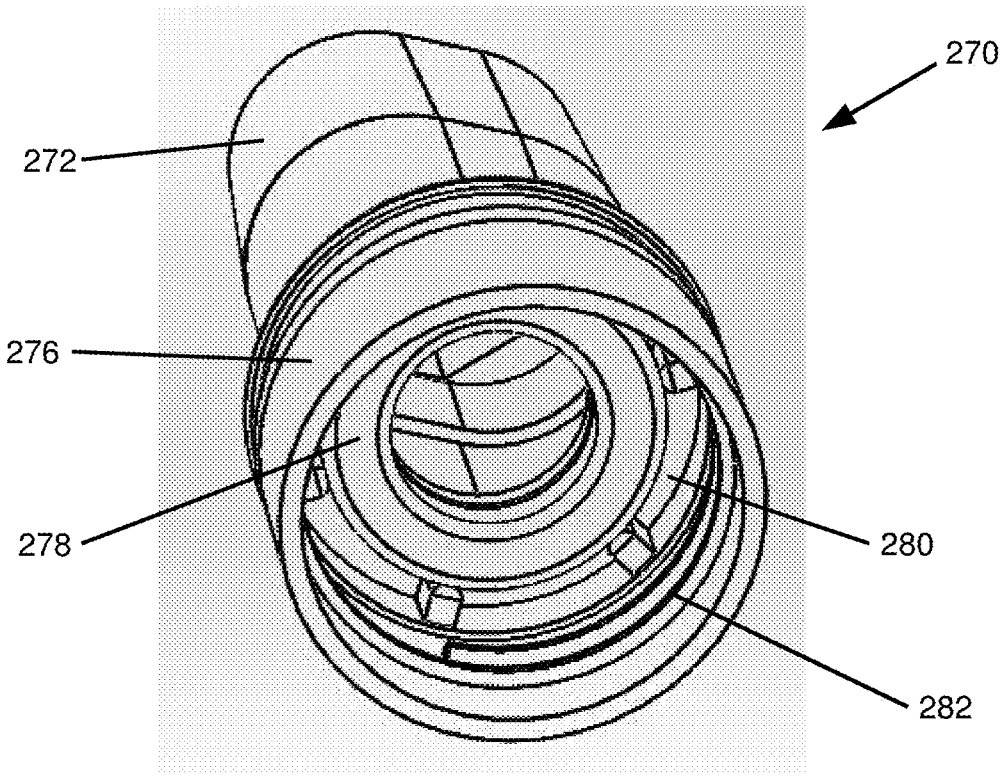
FIG. 26 is a perspective view of an alternative embodiment of a top to a case in accordance with the principles of the invention.

FIG. 24 shows a cross-section of a vaporizer case 120 having a cap 168 and a storage attachment 180 affixed to it. The cap 168 covers the proximal region of the top 270, including the mouthpiece 128. The sleeve 182 forms a friction fit over the distal region 136 of the body 122. The storage compartment 186 of the storage attachment 120 is accessible by unscrewing the screwcap 184 and sized to hold a small amount of material, for example oil or other substances to be vaporized with in the vaporizer housed within the case 120. In FIG. 26 the spring and piston have been removed to better show the flutes 153 running along the length of the padding 152. FIG. 25 shows a cross-section of the padding 152 taken a long plane 155 showing the flutes 153. Those skilled in the art will appreciate that by incorporating flutes around the padding 152, vaporizers having different diameters housed within the case 120 may form a friction fit with the padding 152. Vaporizers housed within the case 120 may have diameters so small that they do not form a friction fit with the padding. In these instances, the padding will nonetheless restrict the amount of transverse movement a vaporizer will be capable of when housed within the case 120.

FIG. 26 shows the top 270 in more detail. The mouthpiece 272 of this embodiment is located at the proximal end of the top 270. The distal region of the top 270 includes an annular cuff 276 having interior threading 282 configured to engage threading on the exterior of the proximal ends of the rest of the body of a case in accordance with the principles of the invention. An annular shoulder to 80 extends about the interior of the top 270 and supports an O-ring 278 that also extends around the inside of the top 270. As described above, this O-ring engages the top of a vaporizer placed within the case of the invention forming a substantially airtight seal. This substantially prevents fluid communication between the mouthpiece of a vaporizer positioned within the top and other interior regions of the case.

Figure 27:
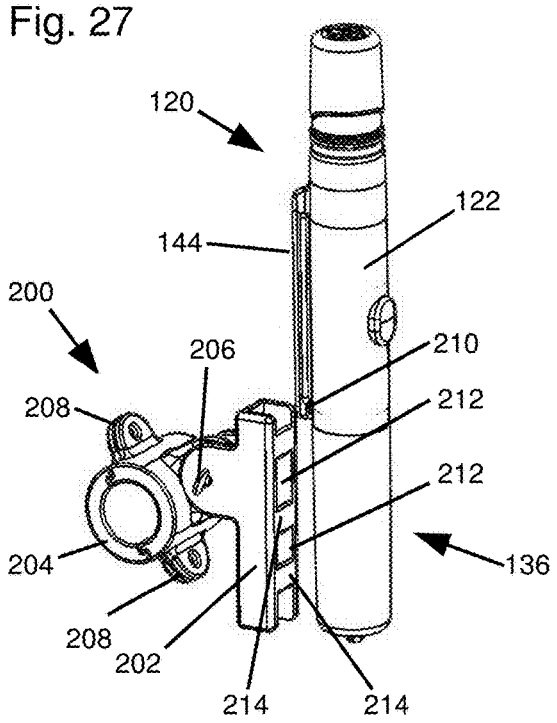
FIG. 27 is a perspective view of an alternative embodiment of a vaporizer case and a handlebar mount in accordance with the principles of the invention.
Figure 28:
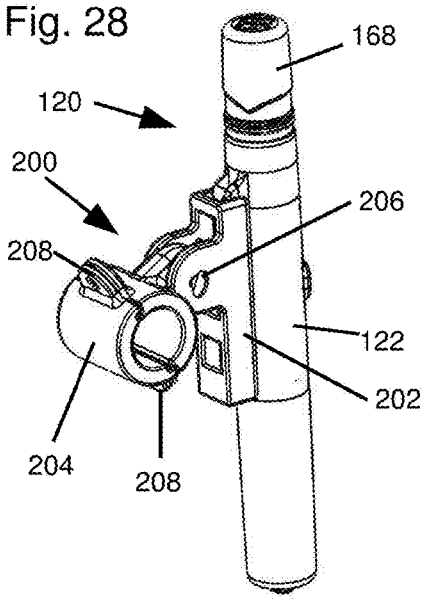
FIG. 28 is a perspective view of an alternative embodiment of a vaporizer case and a handlebar mount in accordance with the principles of the invention.

FIGS. 27 and 28 show another optional attachment for a vaporizer case. A pivoting mount 200 may be removably attached to the clip 144 of a vaporizer case 120 by positioning the base 202 flush against the distal region 136 of the body 122 sliding and sliding it in a proximal direction until the knob 210 at the distal end of the clip 144 enters one of the openings 212 and impinges upon one of the ribs 214 of the base 202, thereby holding it in place removably affixed to the case 120. A cuff 204 is pivotally attached to the base 202 by an adjustable pivot pin 206. The pivot pin 206 may be twisted to loosen or tighten the engagement of the cuff 204 to the base 202 to allow the orientation of the cuff 204 to the case 120. When the cuff 204 has been positions in a desired orientation, the pivot pin 206 may be tightened to maintain the mount 200 and a desired orientation. The cuff 204 may be opened and closed by loosening or removing nuts and bolts end through holes 208. Optionally, the through holes 208 may have integral nuts, thereby reducing the number of separate components. The pivoting mount 200 may thus be affixed firmly in place to a device such as a bicycle or other device. The case 120 may be easily affixed to and removed from the mount 200 by sliding it longitudinally along the base 202.

Figure 29:
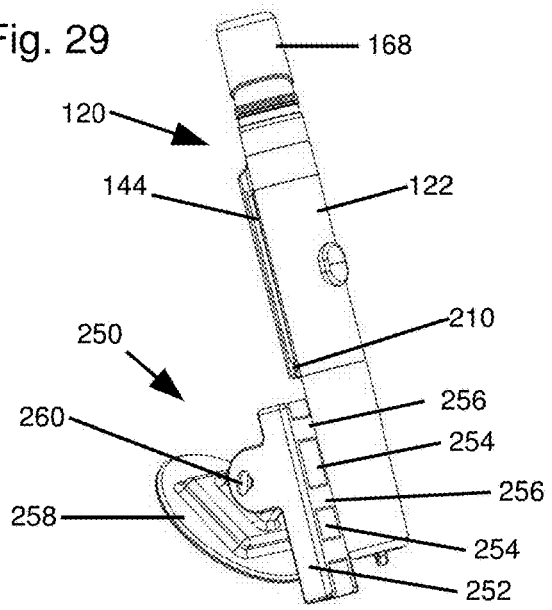
FIG. 29 is a perspective view of an alternative embodiment of a vaporizer case and a surface mount in accordance with the principles of the invention.
Figure 30:
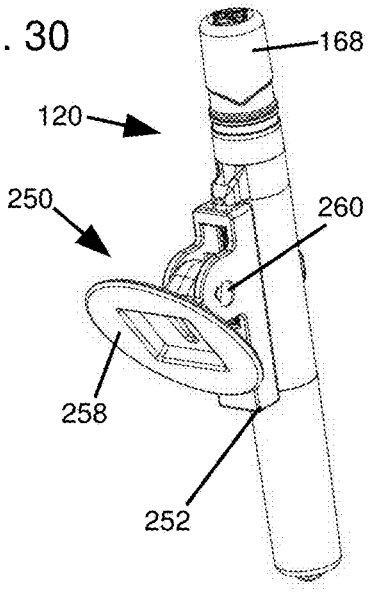
FIG. 30 is a perspective view of an alternative embodiment of a vaporizer case and a surface mount in accordance with the principles of the invention.

FIGS. 29 and 30 show an alternative optional attachment for a vaporizer case. The alternative mount 250 removably affixes to a vaporizer case 120 in substantially the same manner as mount 200. The base 252 includes openings 254 separated by a ribs 256. The knob 210 answers one of the openings 254 and abuts against one of the ribs 256 when the base 252 is placed alongside the case 120 and slid in a proximal direction. An attachment plate 258 is pivotally connected to the base 252 by an adjustable pivot pin 260. The attachment plate 258 in this embodiment is round, but other shapes may be more desirable depending upon the location to which it is being attached. The attachment plate 258 may be affixed to a surface using an adhesive, cement, nuts and bolts, a suction cup or other means. As with the mount 200 shown in FIGS. 27 and 28, the pivot pin 260 may be adjusted so that the vaporizer case 120 is positioned in a desired orientation relative to the attachment plate 258. Optionally, a base for a mount may be provided having interchangeable components that may be pivotally attached to it. For example, the cuff 204 base 202 may be detached from the base 202 by removing the pivot pin 206. The attachment plate 258 may then be pivotally attached to the base 202 using the pivot pin 206.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A protective electronic cigarette case housing an electronic cigarette comprising:

an elongate boxy forming an interior chamber and having a longitudinal length defined by a proximal end and a distal end;

a cylindrical, deformable, transparent region of the body located between the proximal end and the distal end and having an intake valve that is opened when the deformable, transparent region is squeezed;

cylindrical interior padding within the interior chamber and located between the cylindrical, deformable, transparent region and the distal end of the body, wherein the cylindrical interior padding limits transverse movement of the electronic cigarette housed inside the case;

an interior piston at the distal end of the interior chamber and a spring giving a first proximal bias to the interior piston;

a removable top removably affixable to a collar at the proximal end of the body, wherein the removable top has a removable top mouthpiece at a proximal end and an interior annular shoulder at a distal end;

wherein the removable top mouthpiece at the proximal end of the removable top includes a proximal valve that is opened when an operator bites down on it;

wherein the electronic cigarette housed within the protective case has a distal end and a proximal end, the proximal end of the electronic cigarette having an electronic cigarette mouthpiece that extends proximally from a top of the electronic cigarette;

wherein the first proximal bias of the interior piston imparts a second proximal bias to the electronic cigarette, thereby pushing the electronic cigarette mouthpiece against the interior annular shoulder of the removable top and creating a seal between the removable top and the body of the case; and wherein the electronic cigarette has an actuating button, visible through the transparent region of the body, and capable of being actuated by deforming the transparent region of the body.

* * * * *